US005459897A

United States Patent [19]

Wurdack

[11] Patent Number: 5,459,897

[45] Date of Patent: Oct. 24, 1995

[54] COMBINATION TOOL FOR LIFTING FURNITURE AND REMOVING CARPET

[76] Inventor: Roy A. Wurdack, P.O. Box 613, Warrenton, Mo. 63383

[21] Appl. No.: 321,055

[22] Filed: Oct. 5, 1994

[51] Int. Cl.[6] ..... B25F 1/00

[52] U.S. Cl. ..... 7/166; 30/169; 254/131

[58] Field of Search ..... 30/169, 171; 81/45, 81/46; 234/23, 131, 131 R, 131.5; 7/103, 166; 15/236.01, 236.08

[56] References Cited

U.S. PATENT DOCUMENTS

| | | | |
|---|---|---|---|
| 561,499 | 6/1896 | Detert . | |
| 1,434,744 | 11/1922 | Hibbler . | |
| 1,559,976 | 11/1925 | Ness | 254/131 |
| 2,818,642 | 1/1958 | Judd, Jr. . | |
| 2,907,106 | 10/1959 | Lockwood . | |
| 3,987,827 | 10/1976 | Mills | 81/45 |
| 4,009,743 | 3/1977 | Ackerman . | |
| 4,086,699 | 5/1978 | Olkkola | 30/172 |
| 4,182,390 | 1/1980 | Renner | 254/25 X |
| 4,477,972 | 10/1984 | Testa, Jr. . | |
| 5,261,643 | 11/1993 | Wurdack . | |

*Primary Examiner*—Douglas D. Watts
*Attorney, Agent, or Firm*—Grace J. Fishel

[57] ABSTRACT

A combination tool for lifting furniture and modular office panels with adjustable leveling glides mounted on a threaded shaft and for removing glued down carpet. The tool has an elongated handle and a blade pivoted about a fulcrum spaced rearwardly of the front end of the blade. The front end of the blade has a transverse cutting edge and a longitudinal slot opening from the transverse cutting edge for straddling the threaded shaft when the tool is used to lift the furniture and panels. The handle is attached to the blade at an obtuse angle and the blade pivots about a fulcrum spaced rearwardly of the front end of the blade such that the front end of the blade is elevated from about ½ to 2 inches above the floor at full pivot.

8 Claims, 3 Drawing Sheets

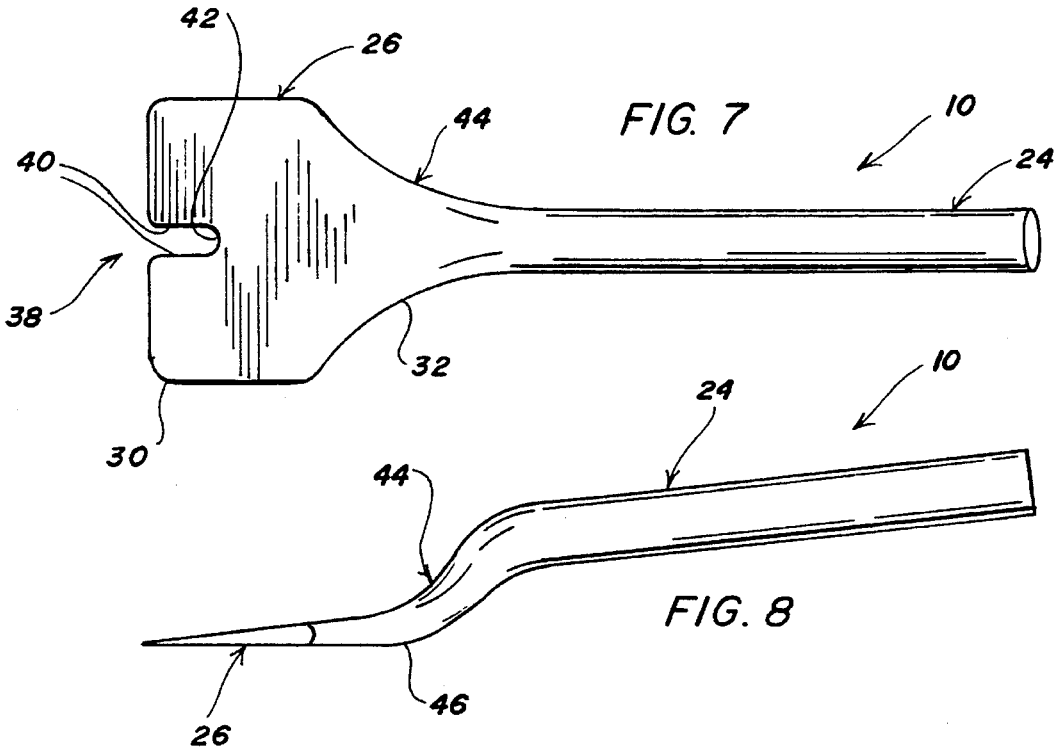
FIG. 7
FIG. 8
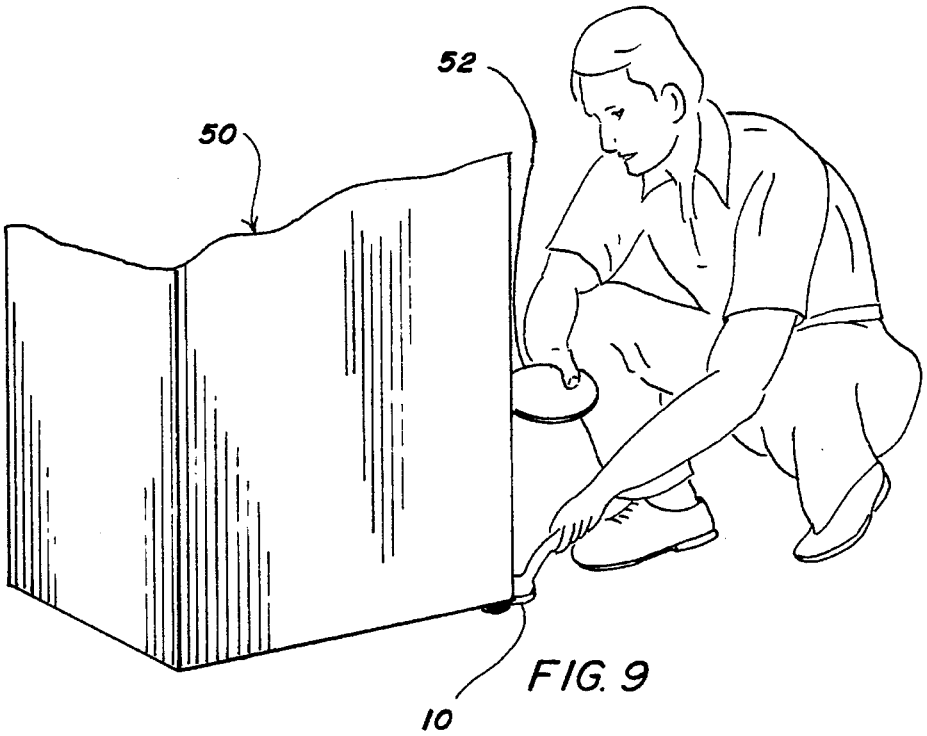
FIG. 9

COMBINATION TOOL FOR LIFTING FURNITURE AND REMOVING CARPET

BACKGROUND OF THE INVENTION

1. Field of the Invention

The present invention relates to a combination tool for lifting furniture and removing glued down or bonded carpet, intended mainly for use by professional carpet installers in the commercial field.

2. Brief Description of the Prior Art

Offices are frequently carpeted for a variety of reasons, including cost, noise suppression and comfort. In commercial installations, it is customary to cement the carpet to the floor to provide it with sufficient body to prevent undue wear. To minimize office disruption, it is preferred not to move the furniture and modular office panels when it comes time to replace the carpet. Otherwise each desk and work area must be cleared of all business supplies and personal items. All electrical, telephone and computer network systems must be disconnected and all computers, telephones, facsimile machines and so forth moved. The furniture or modular office panels are then disassembled as far as necessary and all of the items stored while the new carpet is being laid. Carpet tiles, about 18 inches on a side, have been developed in response to the need to carpet without moving the furniture and modular office panels, giving rise to a need for tools for lifting the furniture slightly off the floor in order to allow the old carpet to be removed and replaced with new carpet tiles.

There are electric floor stripping machines and long handled floor scrapers for removing the carpet in open areas. Such machines and scrapers, however, cannot go into confined areas or under furniture and modular office panels commonly mounted on adjustable leveling glides. In these areas, small strips of carpet are left behind to be cut out by hand, small pieces at a time, further giving rise to a need for a tool that can double as a scraper for removing the small strips of carpet in addition to lifting the furniture slightly off the floor so that the old carpet can be removed and replaced with new carpet tiles. There are pry bars, crowbars, jacks, etc. for lifting furniture and there are small scrapers, etc. for ripping carpet but insofar as known, there is no combination lifter/ripper particularly adapted to the needs of commercial carpet installers.

SUMMARY OF THE INVENTION

In view of the above, it is an object of the present invention to provide a tool for lifting furniture and modular office panels mounted on adjustable leveling glides so that old carpet can be removed and new carpet laid. It is another object to provide a tool, which in addition to functioning as a lifter, can be used as a scraper for removing glued down or bonded carpet under furniture and modular office panels or in other confined areas. Other objects and features of the invention will be in part apparent and in part pointed out hereinafter.

In accordance with the invention, a combination tool for lifting furniture and modular office panels and for removing glued down carpet is provided for furniture and panels having adjustable leveling glides, each glide including a skid mounted on a threaded shaft received in a cooperatively threaded socket provided along a bottom edge of the furniture. The tool has an elongated handle and a blade with a flat bottom, said blade having front and rear ends and being tapered toward the front end. The front end has a transverse cutting edge and a longitudinal slot and the slot has generally parallel side edges for straddling the shaft of the glide.

The rear end of the blade has an upwardly extending shoulder and the handle is joined to the shoulder making an obtuse angle to the bottom of the blade and forming a transverse fulcrum spaced rearwardly of the front end. When the blade is inserted under the furniture with the slot straddling the shaft, a lifting force can be applied to the bottom edge of the furniture adjacent the shaft by rocking the tool about the fulcrum, raising the front end of the blade about ½ to 2 inches above the floor. While the furniture is lifted, glued down carpet can be removed from under the leveling glide and new carpet installed. In addition, the tool can be used as a scraper to cut loose glued down carpet by pushing the transverse cutting edge under the carpet and prying loose the carpet by rocking the tool about the fulcrum.

The invention summarized above comprises the constructions hereinafter described, the scope of the invention being indicated by the subjoined claims.

BRIEF DESCRIPTION OF THE DRAWINGS

In the accompanying drawings, in which two of various possible embodiments of the invention are illustrated, corresponding reference characters refer to corresponding parts throughout the several views of the drawings in which:

FIG. 7 is a top view of second combination tool in accordance with the present invention;

FIG. 8 is a side elevation thereof; and,

FIG. 9 is a perspective view of the second tool being used to lift a corner of a filing cabinet while a slide is being installed.

DETAILED DESCRIPTION OF THE INVENTION

Figure 1:
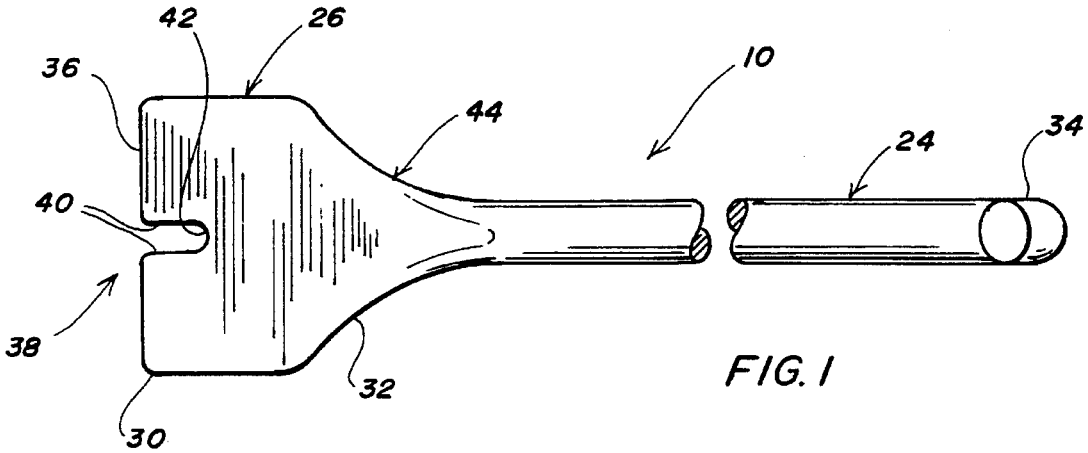
FIG. 1 a top view of a combination tool for lifting furniture and removing glued down carpet in accordance with the present invention, said tool having a blade with a slot.
Figure 2:
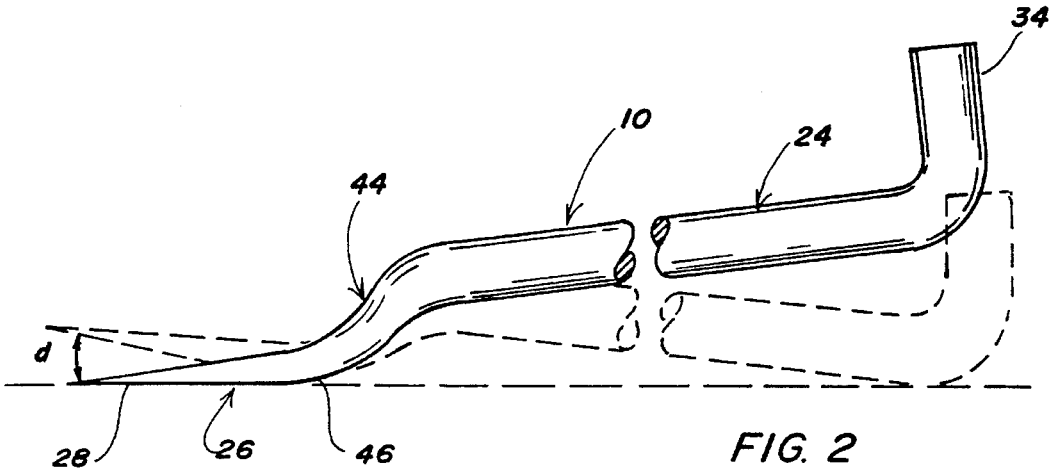
FIG. 2 is a side elevation thereof, showing the tool in fully pivoted condition in broken lines.
Figure 3:
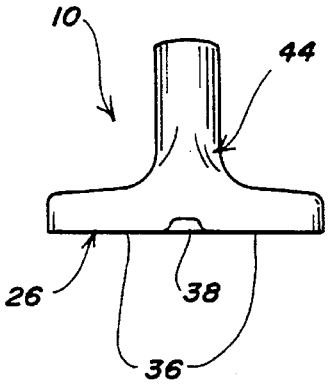
FIG. 3 is a front view thereof.
Figure 4:
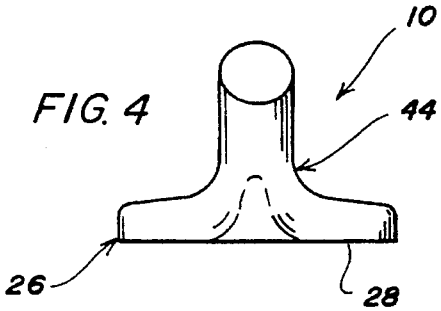
FIG. 4 is a rear view thereof.
Figure 5:
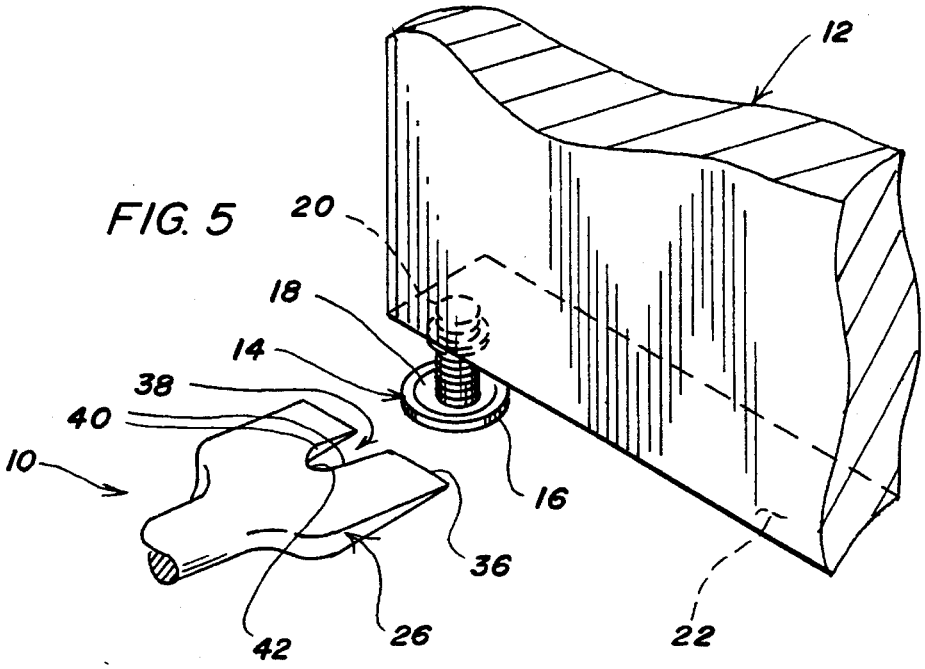
FIG. 5 is a perspective view of a threaded shaft being received in the slot.

Referring to the drawings more particularly by reference character, reference numeral 10 refers to a combination tool for lifting furniture and removing glued down carpet. Many pieces of furniture and modular office panels 12 as shown in FIG. 5 have adjustable leveling glides 14. Each glide 14 has a skid 16 mounted on a threaded shaft 18 received in a cooperatively threaded socket 20 provided along a bottom edge 22 of the furniture. The area immediately adjacent socket 20 is usually reinforced and intended to be weight bearing. When the furniture is lifted along bottom edge 22, it is important that the lifter have a wide blade and that the lifting force be applied to the reinforced area adjacent socket 20. Crowbars and other such pry bars have been used for lifting furniture and modular office panels but these tools can severely damage the bottom edge of the furniture, crushing wire-carrying raceways and the like, and they can slip. Tool 10 obviates these problems.

Turning to FIGS. 1–4 and 7–8, tool 10 has an elongated handle 24 and a blade 26 with a flat bottom 28. It will be understood that blade 26 must be fabricated of a strong tough metal, such as carbon steel which is heat treated to a spring steel temper, and handle 24 must be made of a strong metal so that it does not bend when tool 10 is used as a lifter. Blade 26 has front and rear ends 30, 32, respectively, and is tapered toward front end 30. Blade 26 is preferably rectangular, slightly longer than it is wide. In the embodiment illustrated in FIGS. 7–8, handle 24 is about 8–10 inches long and blade 26 about 3 inches wide and 4 inches long. A larger tool 10 is illustrated in FIGS. 1–4, wherein handle 24 is about 16–20 inches long with an upturned handle extension 34. In this embodiment, blade 26 is about 4 inches wide and 6 inches long. Front end 30 of blade 26 has a transverse cutting edge 36 and a longitudinal slot 38 with parallel marginal side edges 40 for loosely straddling threaded shaft 18 without gripping the threads. Slot 38 is preferably centrally located in transverse cutting edge 36 so that the flanking portions of blade 26 are of equal size to avoid applying undue torque and stress on the modular panels as shown in the drawings, slot 38 is less than half the length of the blade. In addition, slot 38 preferably has a rounded bottom 42 to avoid griping the threads on shaft 18 when tool 10 is being used as a lifter and a depth such that blade 26 reaches under bottom edge 22 of the furniture. For most purposes, a slot about ⅜ inch wide and ¾–1 inch deep satisfies these requirements.

As shown in FIGS. 1–4, rear end 32 of blade 26 is attached to an upwardly turned shoulder 44. Handle 24 is joined to shoulder 44 and makes an obtuse angle with bottom 28 of blade 26. At rear end 32 of bottom 28 where shoulder 44 angles upwardly, blade 26 forms a transverse fulcrum 46 spaced rearwardly of front end 30, about which front end 30 is elevated ½ to 2 inches at full pivot (distance d in FIG. 2). The angle between handle 24 and bottom 28 is otherwise as broad as possible so that handle 24 does not interfere with sliding tool 10 under furniture 12.

Figure 6:
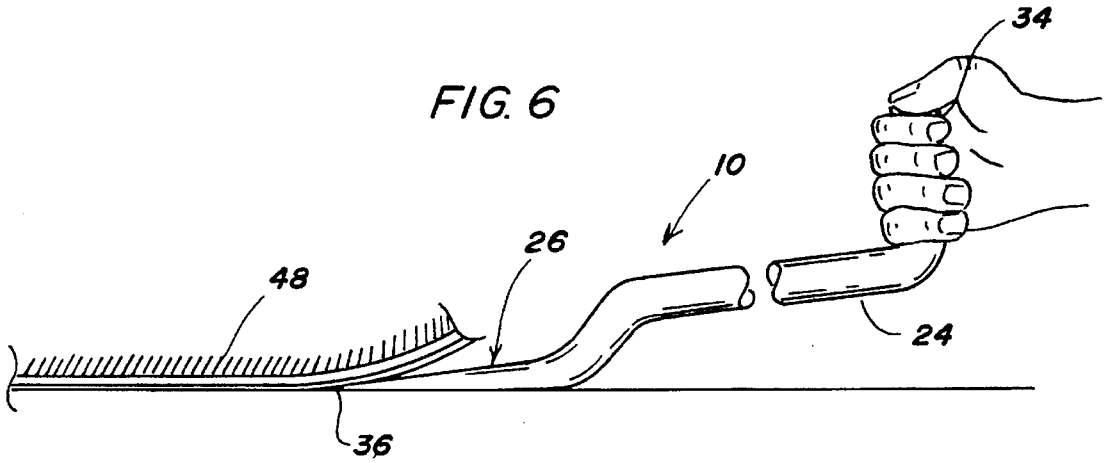
FIG. 6 is a side elevation, partly in section, of the tool being used as a scraper to remove glued down carpet.

In use as shown in FIG. 5, tool 10 can be used for lifting furniture so that strips of an old carpet 48 trapped under leveling glide 14 can be removed and new carpet installed without damaging bottom edge 22. For this purpose, threaded shaft 18 is received in slot 38 as blade 26 is slid under bottom edge 22. With threaded shaft 18 loosely received in slot 38, handle 24 is pressed downwardly, causing blade 26 to pivot about fulcrum 46, raising the furniture such that the old carpet can be removed from beneath the leveling glide and new carpet installed. When not in use lifting furniture, tool 10 can be used as a scraper as shown in FIG. 6 with transverse cutting edge 36 being used to cut strip of glued down carpet 48 loose. Handle extension 34, when present, assists this operation. When handle 24 is pressed downwardly, causing blade 26 to pivot about fulcrum 46, tool can also be used to pry up the carpet. Tool 10 has further utility to the professional carpet installer as shown in FIG. 9 wherein it is shown being used to lift a corner of a filing cabinet 50 or other piece of furniture while a slide 52 is being installed.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

what is claimed:

1. A combination tool for lifting furniture and removing glued down carpet, said furniture having adjustable leveling glides, each said glide including a skid mounted on a threaded shaft received in a cooperatively threaded socket provided along a bottom edge of the furniture, said tool comprising an elongated handle, a wide blade with a flat bottom, said blade being at least 4 inches long and having front and rear ends and tapered toward the front end, said front end having a transverse cutting edge and a longitudinal slot with generally parallel marginal side edges for straddling the shaft of the glide, said slot being less than half the length of the blade, said rear end including an upwardly extending shoulder, said handle joined to the shoulder and making an obtuse angle to the bottom of the blade and forming a transverse fulcrum spaced rearwardly of the front end such that the front end of the blade is elevated from about ½ to 2 inches at full pivot, said blade stopped when the blade is inserted under the furniture with the slot straddling the shaft whereby a lifting force can be applied to the bottom edge of the furniture adjacent the shaft by rocking the tool about the fulcrum and whereby the tool can be used as a scraper to cut loose the glued down carpet by pushing the transverse cutting edge under the carpet and prying loose the carpet by rocking the tool about the fulcrum.

2. The tool of claim 1 wherein the slot has a rounded bottom edge.

3. The tool of claim 2 wherein the blade is generally rectangular and at least 3 inches wide.

4. The tool of claim 3 wherein the slot is centrally located in the transverse cutting edge and about ⅜ inch wide and from about ¾ to 1 inch deep.

5. A combination tool for lifting furniture and removing glued down carpet, said furniture having adjustable leveling glides, each said glide including a skid mounted on a threaded shaft received in a cooperatively threaded socket provided along a bottom edge of the furniture, said tool comprising an elongated handle with first and second ends, a wide, generally rectangular blade with a flat bottom, said blade having front and rear ends and tapered toward the front end, said front end having a transverse cutting edge and a longitudinal slot with generally parallel marginal side edges for straddling the shaft of the glide and a generally rounded bottom, said slot opening from the transverse cutting edge, said rear end including an upwardly extending shoulder, said first end of the handle joined to the shoulder and said handle making an obtuse angle to the bottom of the blade and forming a transverse fulcrum spaced rearwardly of the front end such that the front end of the blade is elevated from about ½ to 2 inches at full pivot, said blade stopped by the taper of the blade or by the bottom of the slot when the blade is inserted under the furniture with the slot straddling the shaft whereby a lifting force can be applied to the bottom edge of the furniture adjacent the shaft by rocking the tool about the fulcrum and whereby the tool can be used as a scraper to cut loose the glued down carpet by pushing the transverse cutting edge under the carpet and prying loose the carpet by rocking the tool about the fulcrum.

6. The tool of claim 5 wherein the handle is about 8 to 10 inches long, the blade is about 3 inches wide and 4 inches long and the slot is about ⅜ inch wide and from about ¾ to 1 inch deep.

7. The tool of claim 5 wherein the second end of the handle is joined to an upwardly directed handle extension.

8. The tool of claim 5 wherein the handle is about 16 to 20 inches long, the blade is about 4 inches wide and 6 inches long and the slot is about ⅜ inch wide and from about ¾ to 1 inch deep.

* * * * *